US006195802B1

(12) United States Patent
Armellino

(10) Patent No.: US 6,195,802 B1
(45) Date of Patent: Mar. 6, 2001

(54) TACTICAL VEST

(75) Inventor: Stephen E. Armellino, Santa Fe Spring, CA (US)

(73) Assignee: U.S. Armor Corporation, Santa Fe Spring, CA (US)

( * ) Notice: Subject to any disclaimer, the term of this patent is extended or adjusted under 35 U.S.C. 154(b) by 0 days.

(21) Appl. No.: 09/489,578

(22) Filed: Jan. 21, 2000

Related U.S. Application Data

(60) Provisional application No. 60/116,971, filed on Jan. 21, 1999.

(51) Int. Cl.[7] ..... A41D 13/00
(52) U.S. Cl. ..... 2/102; 2/468; 2/2.5
(58) Field of Search ..... 2/102, 468, 69, 2/94, 93, 85, 108, 2.5, 247, 249–250, 129, 44, 455, 462, 410

(56) References Cited

U.S. PATENT DOCUMENTS

| | | | | |
|---|---|---|---|---|
| 3,497,872 | * | 3/1970 | Mitchell | 2/468 |
| 4,501,023 | * | 2/1985 | Billberry | 2/44 |
| 4,590,622 | * | 5/1986 | Wolfe et al. | 2/455 |
| 4,996,720 | * | 3/1991 | Fair | 2/455 |
| 5,483,698 | * | 1/1996 | Douglas | 2/255 |
| 6,067,665 | * | 5/2000 | DePalma et al. | 2/468 |

* cited by examiner

*Primary Examiner*—John J. Calvert
*Assistant Examiner*—Tejash Patel
(74) *Attorney, Agent, or Firm*—Peacock, Myers & Adams

(57) ABSTRACT

A tactical vest with a partitioned collar and/or a tactical vest with a mount to adjust the positioning of a firearm upon the shoulder.

29 Claims, 10 Drawing Sheets

TACTICAL VEST

CROSS-REFERENCE TO RELATED APPLICATIONS

This application claims the benefit of the filing of U.S. Provisional Patent Application Ser. No. 60/116,971, entitled Tactical Vest and Holster, filed on Jan. 21, 1999 and the specification thereof is incorporated herein by reference.

BACKGROUND OF THE INVENTION

1. Field of the Invention (Technical Field)

The present invention relates to a tactical vest with an adjustable collar and/or an adjustable pre-defined rifle positioning system for law enforcement, military, and similar operations.

2. Background Art

Tactical vests are used by the military and specialized law enforcement units. The vests may include body armor to protect the wearer from enemy projectiles. Some tactical vests have a specialized function, for example, a tactical vest specially designed for medical personnel.

It is known in the art that tactical vests come equipped with or without a protective collar. In the case of the collared vests, the collar may interfere with other protective equipment. For example, the collar may interfere with the proper seating of the wearer's helmet causing the helmet to be pushed unnaturally forward. Therefore, there is a need to have a tactical vest with the design flexibility to raise or lower the collar under certain circumstances.

There is also a need for a rifle retention system. The rifle retention system allows the user to quickly bring his or her weapon up to the shoulder such that the firearm is automatically brought to a pre-set position allowing for greater shooting accuracy.

SUMMARY OF THE INVENTION (DISCLOSURE OF THE INVENTION)

A vest, preferably a tactical vest, comprising a partitioned collar. The partitioned collar comprises at least one rear panel that is raiseable and lowerable, preferably about a fold located at the base of the rear panel, such that when raised the rear panel covers the back portion of a neck. When the rear panel is lowered the rear panel is reversibly attachable to an upper back portion of the vest. In the preferred embodiment, the partitioned collar comprises at least one rear panel and at least two side panels such that the rear panel fastens to the side panels, preferably with a strap, when the rear panel is raised. Preferably, the strap comprises reversibly attachable hooks and loops, such as a Velcro® fastener, to secure the rear panel to the side panels. The vest may optionally comprise a non-skid surface on at least one front shoulder portion of the vest.

The vest may optionally comprise a mount in a pre-defined, adjustable position on a front shoulder portion of the vest to assist in the securing of a firearm. In the preferred embodiment, the mount comprises a tube that is adjustable laterally across the shoulder. The mount comprises an upper and lower fastener to securely attach the mount in a pre-defined position to the upper and lower shoulder portion of the vest. To further secure the upper portion of the mount, the vest may optionally comprise at least one flap, preferably a flap with reversibly attachable hooks and loops, located at the top shoulder portion of the vest that folds over the upper fastener of the mount.

A vest, preferably a tactical vest, comprising a mount, preferably a tube, in a pre-defined, adjustable position on a front shoulder portion of the vest to assist in the securing of a firearm. The vest may optionally comprise a non-skid surface on at least one front shoulder portion of the vest. In the preferred embodiment, the mount is adjustable laterally across the shoulder. The mount comprises an upper and lower fastener to securely attach the mount in a pre-defined position to the upper and lower shoulder portion of the vest. To further secure the upper portion of the mount, the vest may optionally comprise at least one flap, preferably a flap with reversibly attachable hooks and loops, located at the top shoulder portion of the vest that folds over the upper fastener of the mount. In the preferred embodiment the mount comprises rubber, preferably neoprene, and a sleeve, preferably a sleeve comprising webbing.

A primary object of the present invention is to provide a tactical vest with a partitioned collar.

Another object of the present invention is to provide a pre-defined, firearm positioning system on the shoulder of the vest.

A primary advantage of the present invention is that the partitioned collar does not restrict the head movement of a helmeted wearer when the rear panel of the collar is in the down position.

Another advantage of the present invention is that the partitioned collar can be adjusted to the particular neck size of the wearer.

Another advantage of the present invention is that the rifle retention system allows the user to set the position of his or her firearm upon the shoulder for greater shooting accuracy under time-limited conditions.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

Figure 1:
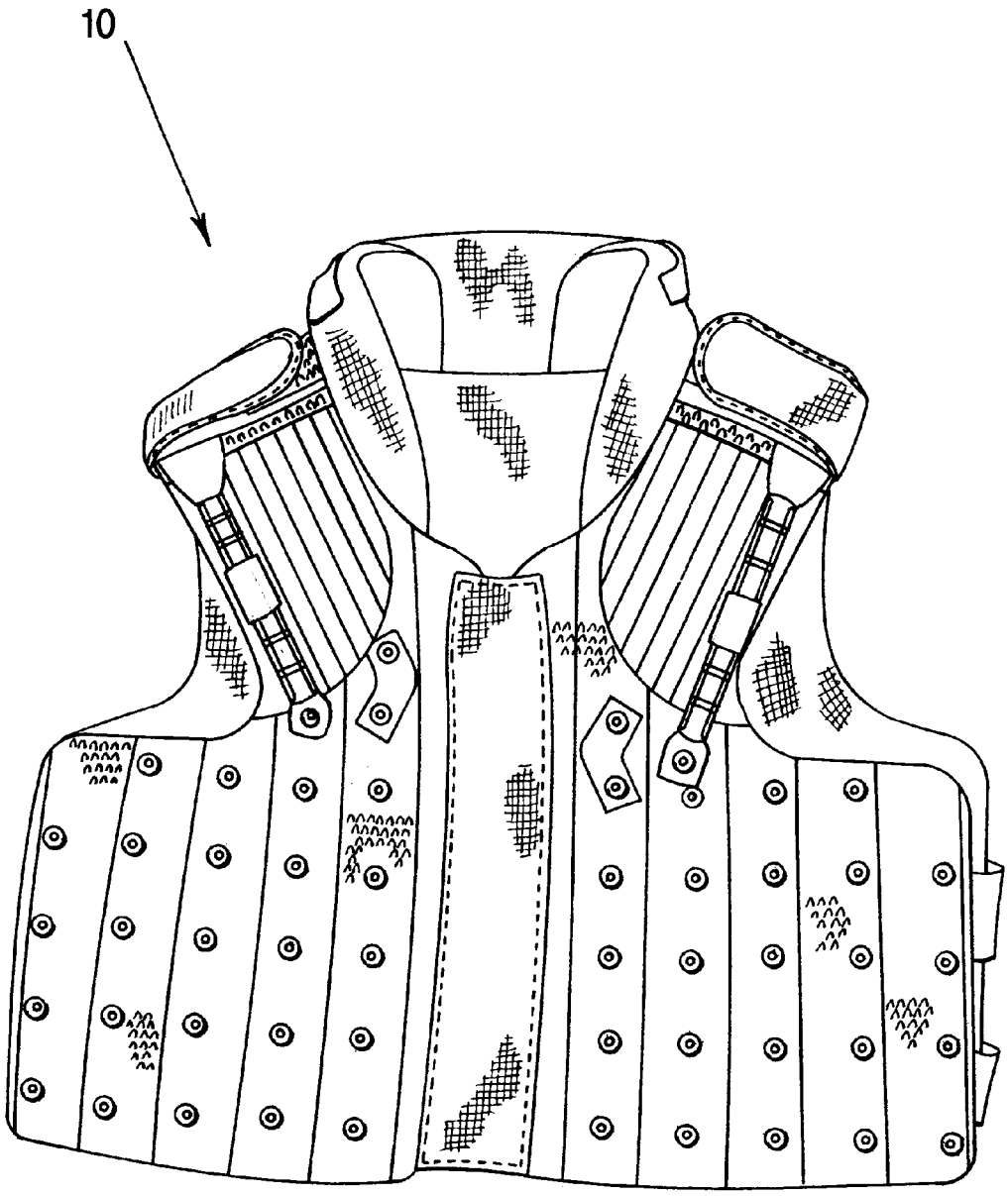
FIG. 1 is a pictorial representation of the front of the vest.
Figure 2:
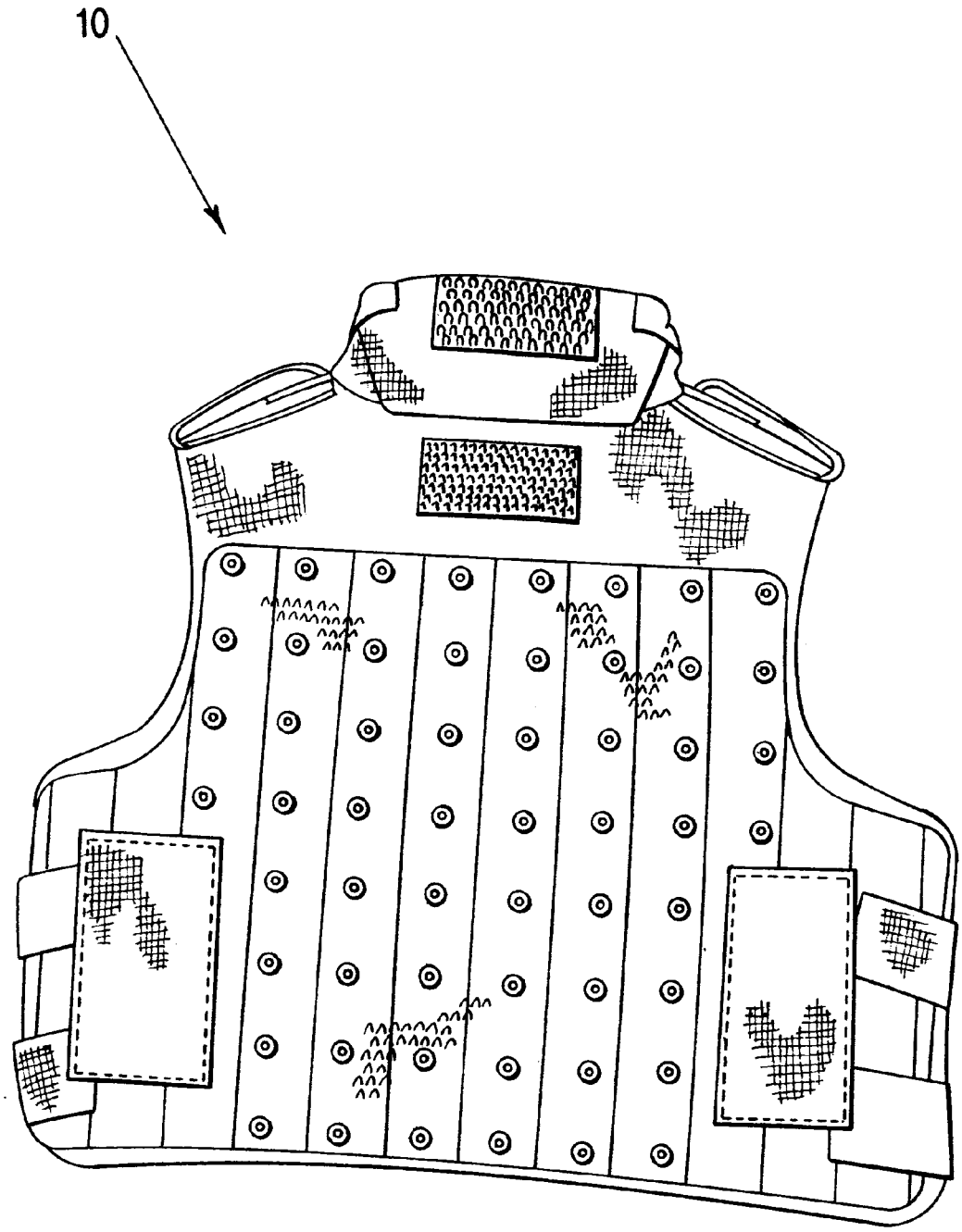
FIG. 2 is a pictorial representation of the back of the vest with the neck collar in the up position.

The present invention is a vest with a partitioned collar 12 to form an armadillo-like protection of the neck area. The partitioned collar 12 comprises at least one rear panel 16, and at least two side panels 14 and 14'. In the preferred embodiment, the present invention comprises a right side panel 14, a left side panel 14', and a rear panel 16. FIGS. 1 and 2 depicts the present invention incorporated into other known features of a tactical vest with body armor, i.e., bulletproof materials. The present invention may be incorporated into tactical vests or other clothing without body armor. The term vest, as used throughout the claims, is intended to include clothing with a collar and/or shoulder mount, and as such could be a shirt, coat, sweater, and the like.

Figure 3:
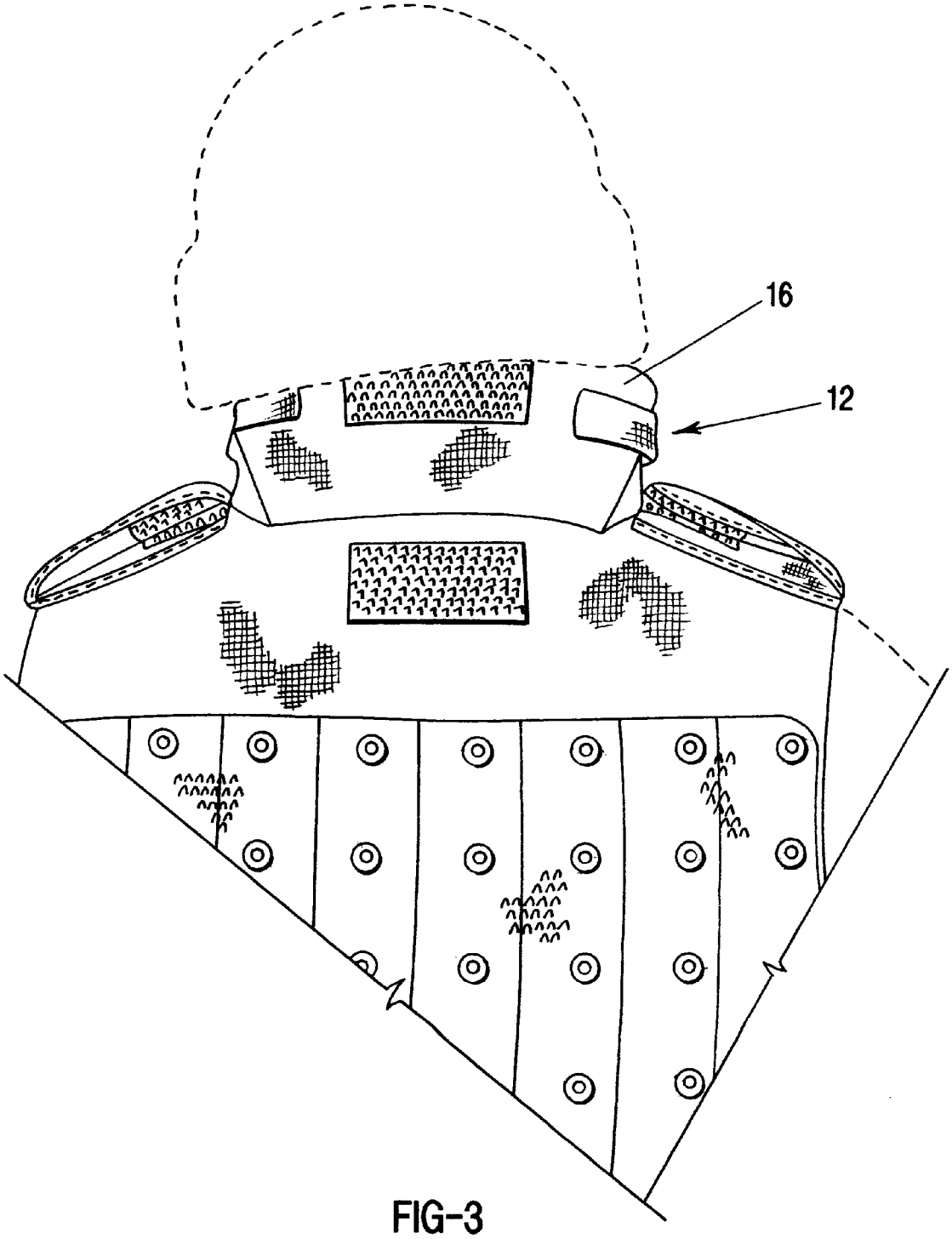
FIG. 3 is a pictorial representation of the upper back of the vest with the neck collar in the up position when a helmeted user wears the vest.
Figure 4:
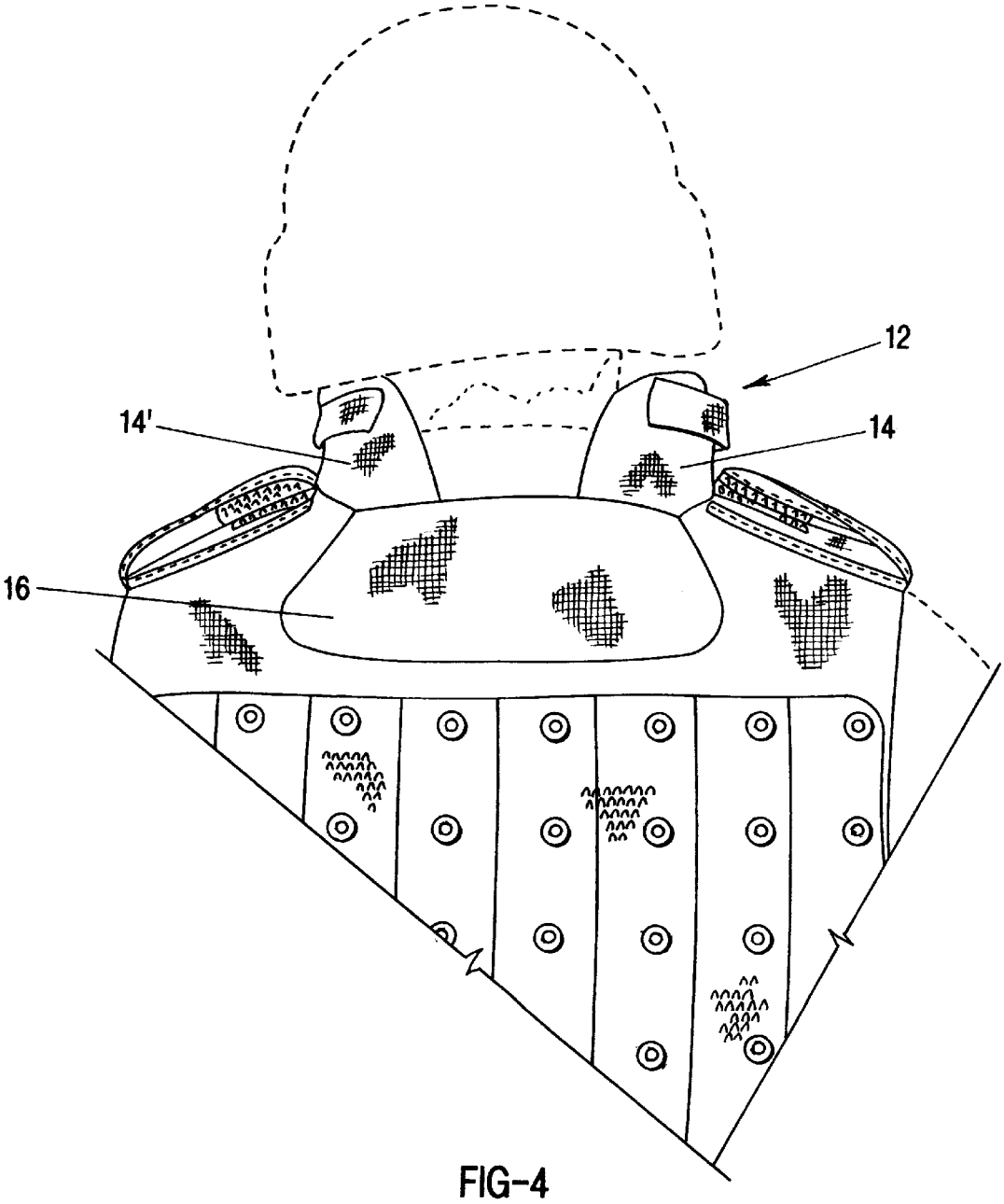
FIG. 4 is a pictorial representation of the upper back of the vest with the neck collar in the down position when a helmeted user wears the vest.
Figure 5:
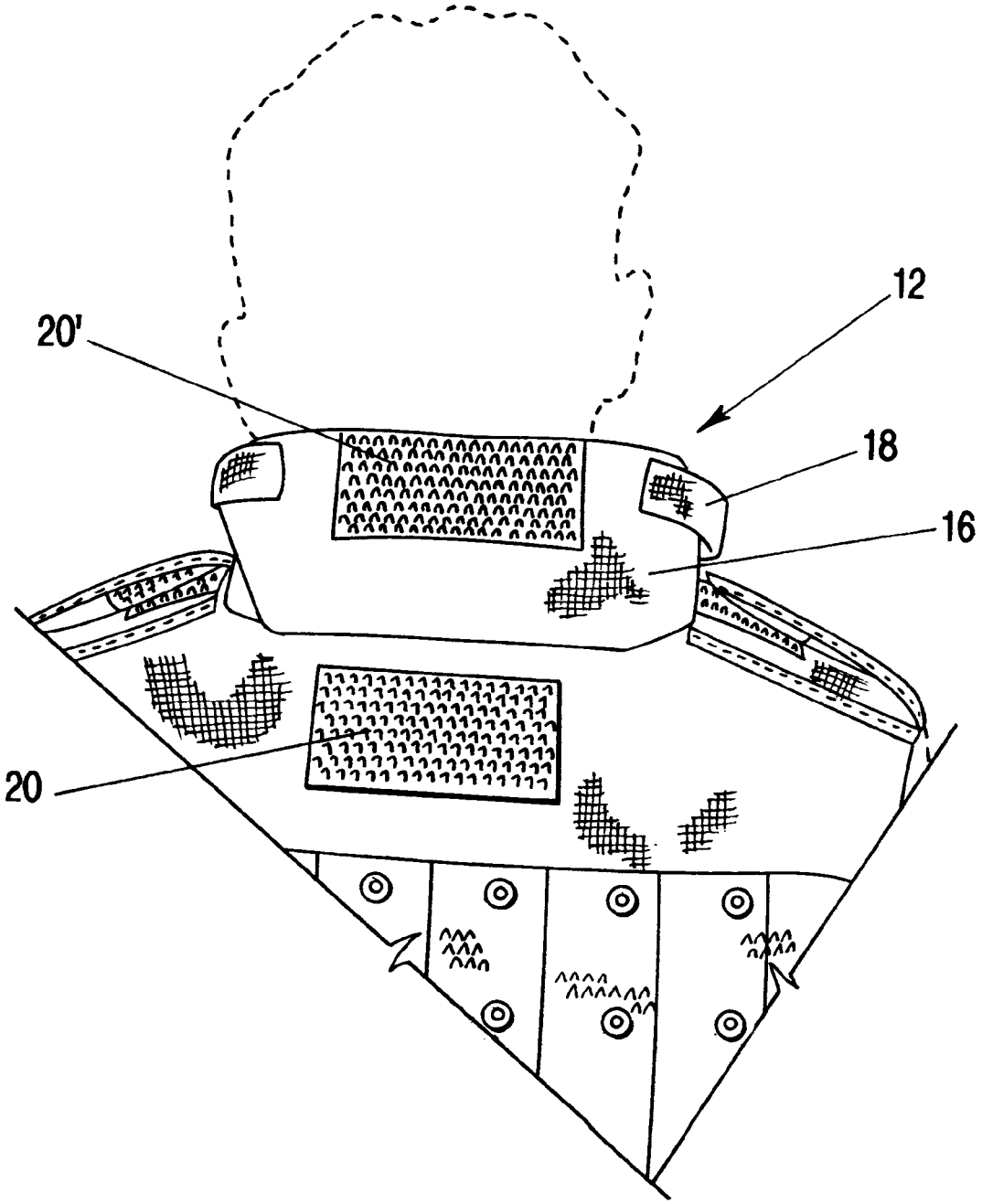
FIG. 5 is a pictorial representation of the upper back of the vest with the neck collar in the up position.
Figure 6:
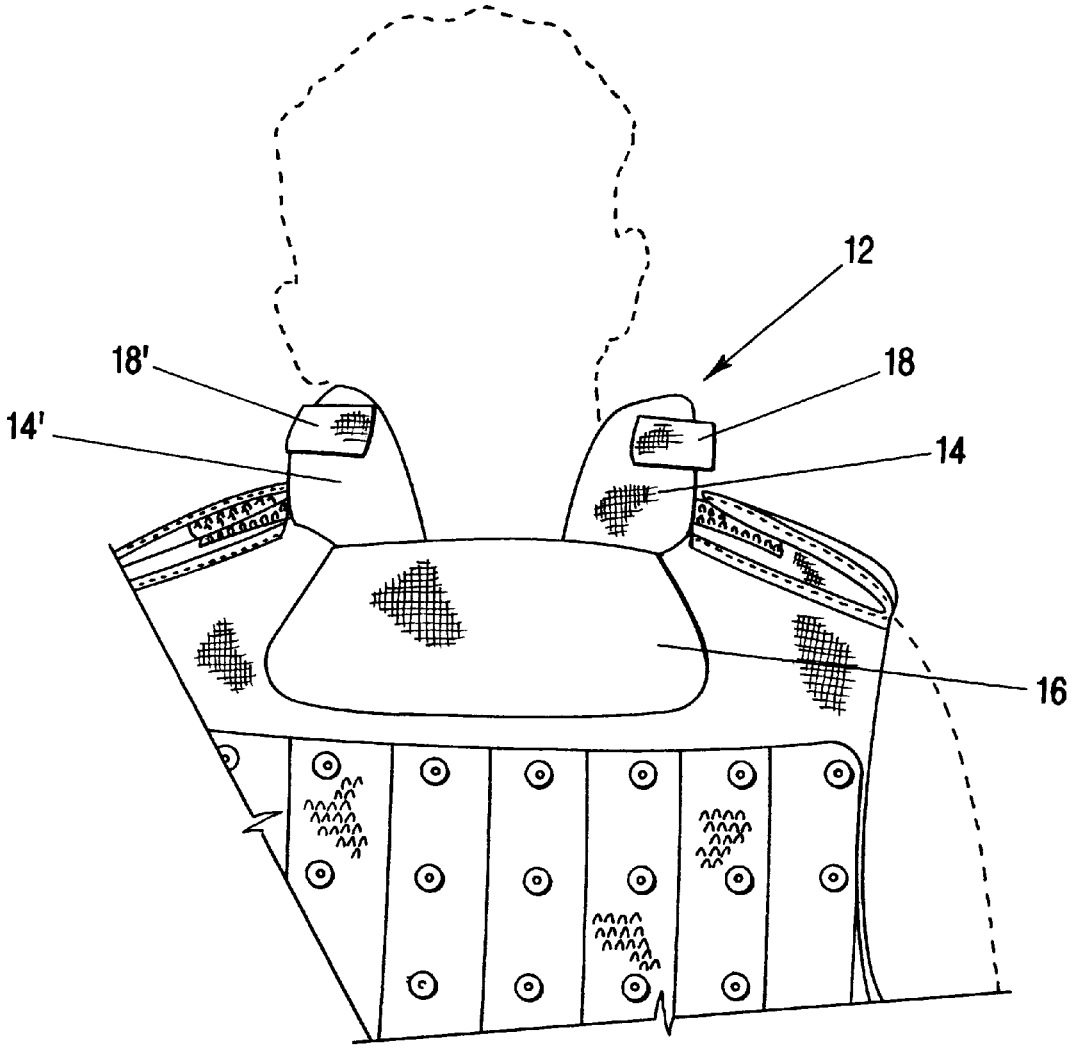
FIG. 6 is a pictorial representation of the upper back of the vest with the neck collar in the down position.
Figure 7:
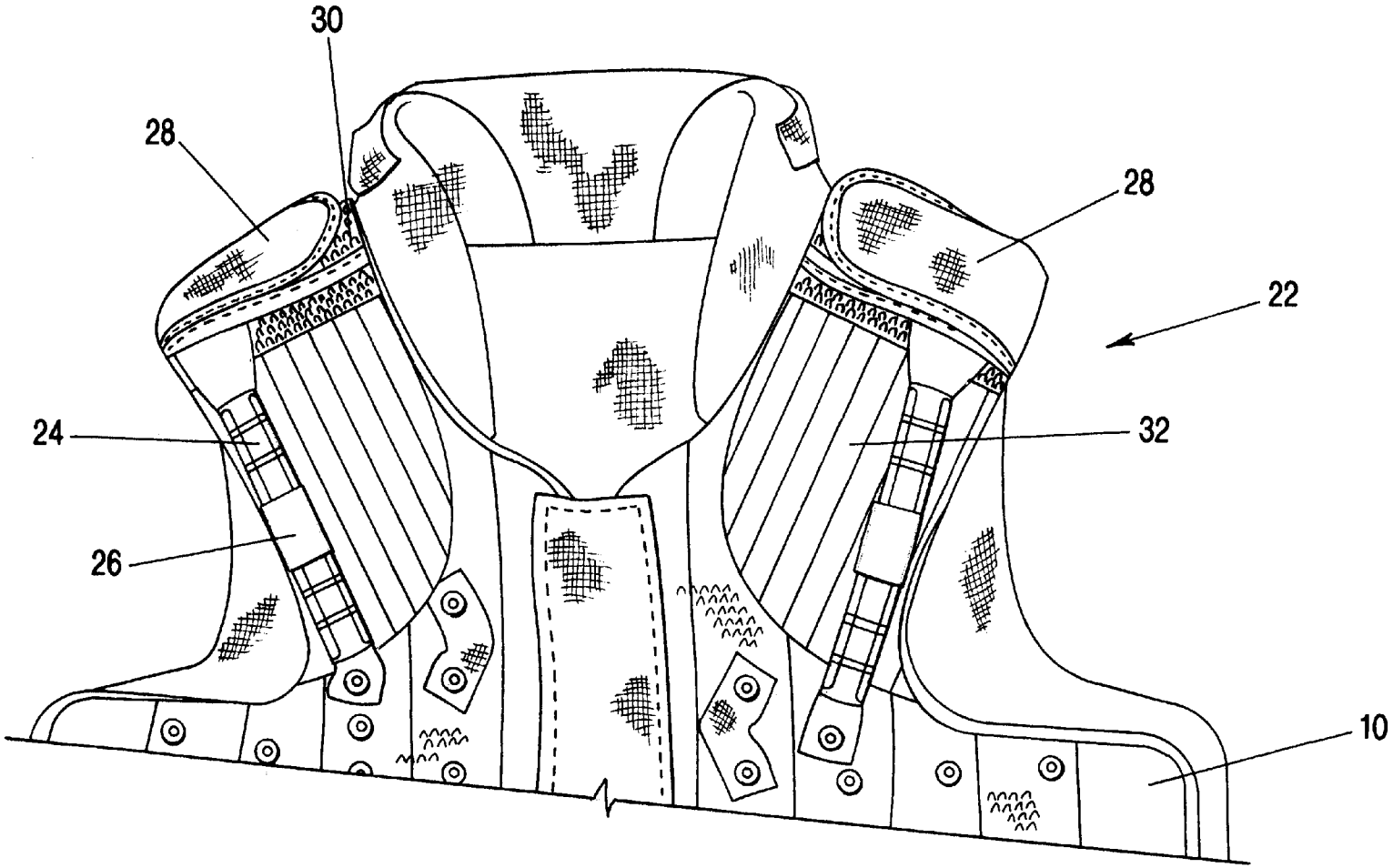
FIG. 7 is a pictorial representation of the upper front of the vest with the rifle retention system.
Figure 8:
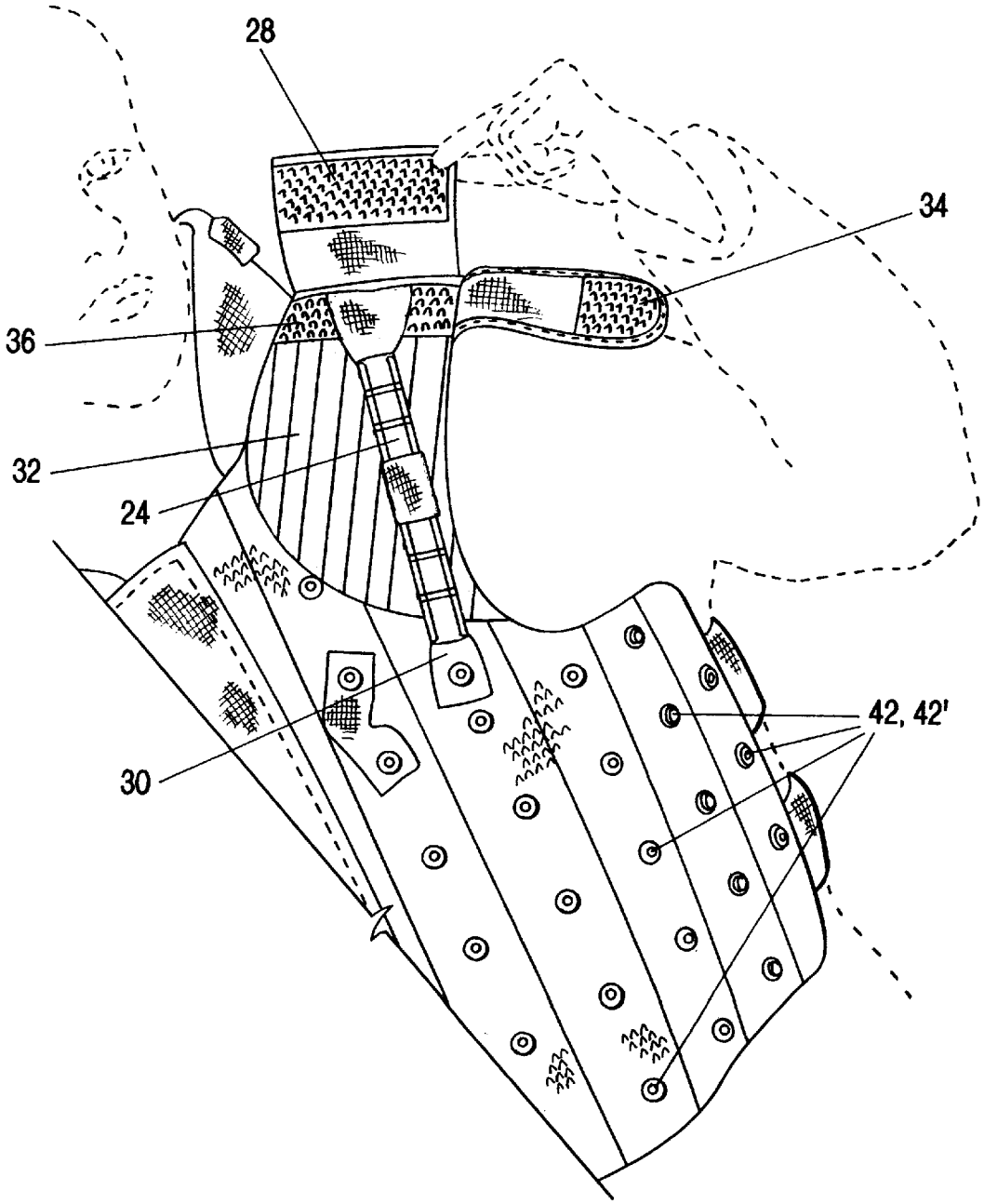
FIG. 8 is a pictorial representation of the upper left front of the vest with the rifle retention system with securing straps unattached prior to adjustment.
Figure 9:
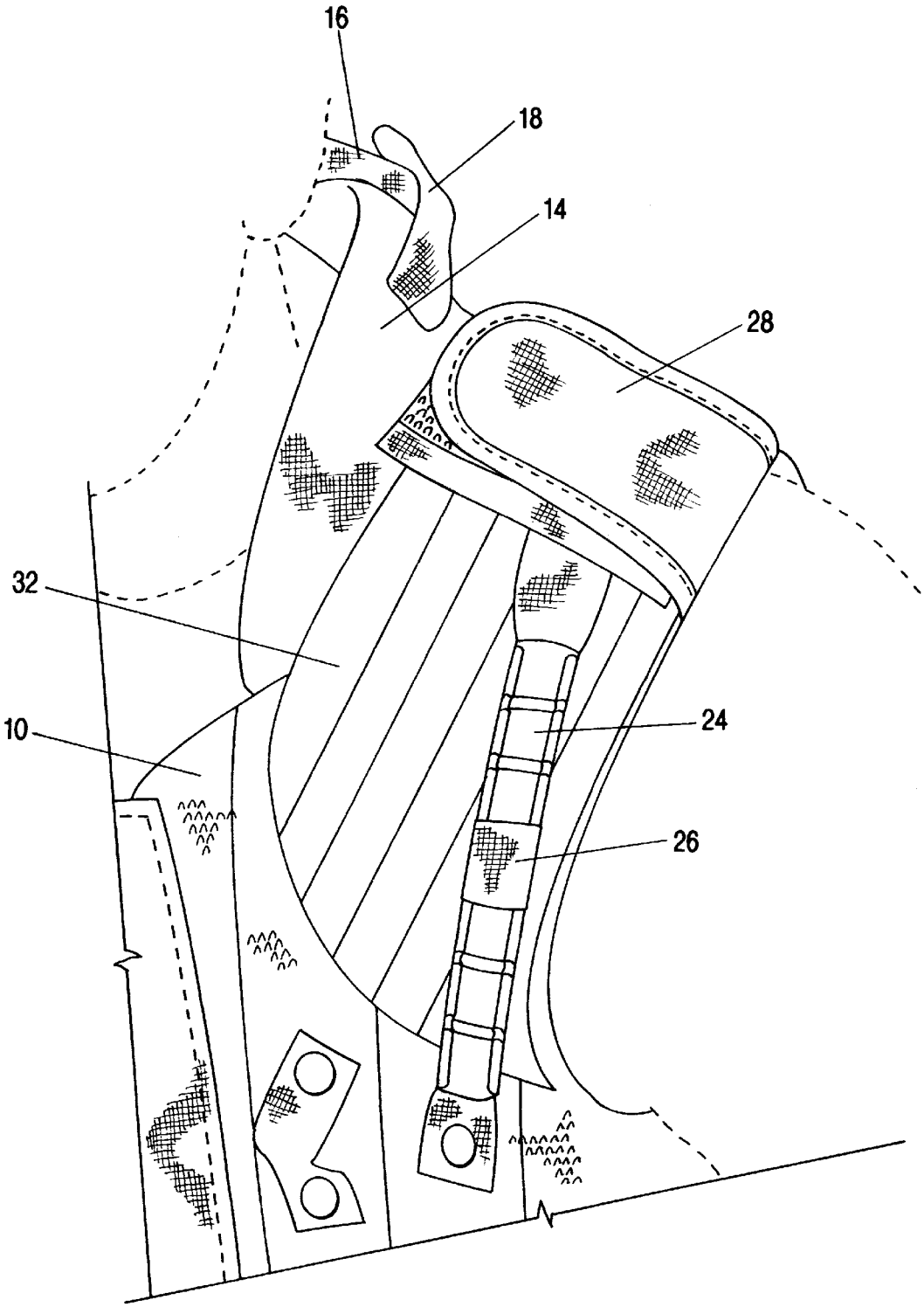
FIG. 9 is a pictorial representation of the upper left front of the vest with the rifle retention system with securing straps attached following adjustment.
Figure 10:
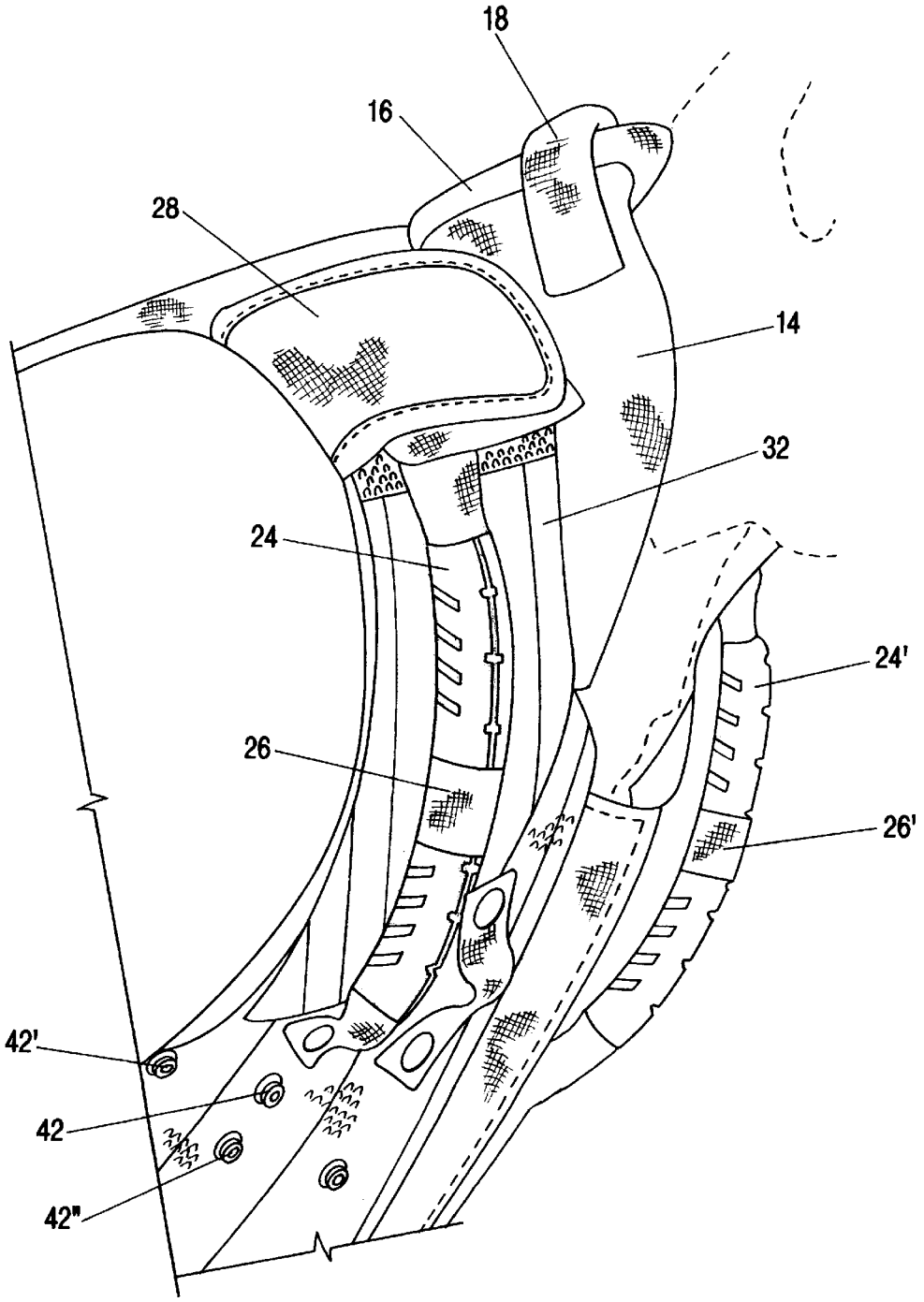
FIG. 10 is a pictorial representation of the upper right front of the vest with the rifle retention system with adjustable rifle positioning tube.

The helmet friendly collar 12 is best shown in FIGS. 3–6. As shown in FIG. 4, collar 12 comprises three components, two free standing side panels 14 and 14' and a rear panel 16. As shown in FIG. 5 when the rear panel 16 is in the up position and attached to side panels 14 and 14', the collar 12 provides complete neck protection for the wearer. However, as shown in FIG. 3, when a helmet is worn, the collar 12 often interferes with the helmet, providing discomfort and sometimes poor seating of the helmet, particularly when the wearer is in a prone position. The present invention alleviates these problems by detaching rear panel 16 from side panels 14 and 14'. The rear panel 16 is then folded down against the top back portion of the vest as shown in FIG. 6.

When in the raised position, rear panel 16 is fastened to side panels 14 and 14' preferably, by straps 18 and 18', respectively. In the preferred embodiment, the straps 18 and 18' are permanently fastened to side panels 14 and 14', respectively. The straps 18 and 18' are then reversibly attachable to the raised rear panel by a strap clip, buckle, snaps, or preferably with a Velcro® fastener (hook and loop or other similar materials referred to herein as Velcro® or hooks and loops). The present invention may also be designed with straps 18 and 18' permanently attached to rear panel 16 and reversibly attachable to the side panels 14 and 14'. When in the lower position rear panel 16 is reversibly attachable to the top back portion of the vest. In the preferred embodiment, the rear panel 16 is secured with a Velcro® fastener. The three-panel adjustable collar 12 also provides for individual adjustment for various size necks. Panels are preferably made of a ballistic material to prevent bullet penetration.

The rifle retention system 22 is best shown in FIGS. 7–10. The rifle retention system 22 is designed to enable the wearer to correctly and comfortably position the butt of a weapon into his/her shoulder area. This can be adjusted for any size wearer in an infinite number of positions according to the wearer's individual preference in firing the weapon. This system enables the user infinite levels of adjustment of the retention system by moving it up and down or laterally across the shoulder area.

The rifle retention system comprises a non-skid material 32, preferably rubber, and a rigid tube 24, preferably a rigid neoprene tube with a nylon webbed sleeve 26. The top portion of tube 24 is secured to the ballistic vest 10, preferably by utilizing flaps 28 and 34, though snaps or other attachment means may be utilized. In the preferred embodiment, a fastener, preferably a Velcro® fastener, on the tube 24 attaches to a fastener 36, preferably a Velcro® fastener, on the top shoulder portion of the vest. Flap 28 with fastener, preferably a Velcro® fastener, is folded over fastener 36, preferably a Velcro® fastener. An additional flap 34 with fastener, preferably a Velcro® fastener, is then folded over flap 28. Thus, the top of tubing 24 can be moved laterally across the top of the shoulder to a number of pre-set positions. Likewise, snaps 30 or other fasteners on vest 10, allow bottom of tubing 24 to move side to side along the chest of the wearer. Thus, the wearer can laterally adjust the tubing 24 to a number of pre-set positions across the shoulder. This pre-defined position is particularly useful in tactical situations, when there is little time to correctly position the rifle on he shoulder. The rifle abuts inside of tubing 24 (i.e. on the neck side) when properly positioned. Tubing 24 is preferably rounded, but may have other configurations (e.g. rectangular, square, triangular cross sections). Tubing 24 is best shown in the side view of FIG. 10.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A vest comprising a partitioned collar comprising:

at least one rear panel;

wherein said rear panel is raiseable and lowerable such that when raised said rear panel covers a back portion of a neck; and wherein when said rear panel is lowered said rear panel is reversibly attachable to an upper back portion of said vest.

2. The vest of claim 1 comprising a tactical vest.

3. The vest of claim 1 wherein said rear panel is raiseable and lowerable about a fold located at a base of said rear panel.

4. The vest of claim 1 wherein said collar comprises at least two side panels.

5. The vest of claim 1 wherein said partitioned collar comprises at least one rear panel and at least two side panels.

6. The vest of claim 1 wherein said partitioned collar further comprises a fastener to fasten said rear panel to said side panels when said rear panel is raised.

7. The vest of claim 6 wherein said fastener comprises a strap.

8. The vest of claim 7 wherein said strap comprises reversibly attachable hooks and loops to secure said rear panel to said side panels when said rear panel is raised.

9. The vest of claim 1 further comprising a mount in a pre-defined, adjustable position on a front shoulder portion of said vest to assist in the securing of a firearm.

10. The vest of claim 9 wherein said mount comprises a tube.

11. The vest of claim 9 wherein said mount is adjustable laterally across the shoulder.

12. The vest of claim 9 wherein said mount comprises an upper and lower fastener to securely attach said mount in a pre-defined position to said upper and lower shoulder portion of said vest.

13. The vest of claim 12 further comprising at least one flap located at the top shoulder portion of said vest that folds over said upper fastener of said mount.

14. The vest of claim 13 wherein said at least one flap located at the top shoulder comprises reversibly attachable hooks and loops.

15. The vest of claim 9 wherein at least one said front shoulder portion of said vest further comprises a non-skid surface.

16. A vest comprising:

a partitioned collar comprising at least one rear panel and at least two side panels; and a fastener to fasten said rear panel to said side panels when said real panel is raised.

17. The vest of claim 16 comprising a tactical vest.

18. The vest of claim 16 wherein said rear panel is raiseable and lowerable such that when raised said rear panel covers a back portion of a neck.

19. The vest of claim 18 wherein said rear panel is raiseable and lowerable about a fold located at a base of said rear panel.

20. The vest of claim 18 wherein when said rear panel is lowered said rear panel is reversibly attachable to an upper back portion of said vest.

21. The vest of claim 18 wherein said fastener comprises a strap.

22. The vest of claim 21 wherein said strap comprises reversibly attachable hooks and loops to secure said rear panel to said side panels when said rear panel is raised.

23. The vest of claim 18 further comprising a mount in a pre-defined, adjustable position on a front shoulder portion of said vest to assist in the securing of a firearm.

24. The vest of claim 23 wherein at least one said front shoulder portion of said vest further comprises a non-skid surface.

25. The vest of claim 23 wherein said mount comprises a tube.

26. The vest of claim 23 wherein said mount is adjustable laterally across the shoulder.

27. The vest of claim 23 wherein said mount comprises an upper and lower fastener to securely attach said mount in a pre-defined position to said upper and lower shoulder portion of said vest.

28. The vest of claim 27 further comprising at least one flap located at the top shoulder portion of said vest that folds over said upper fastener of said mount.

29. The vest of claim 28 wherein said at least one flap located at the top shoulder portion comprises reversibly attachable hooks and loops.

* * * * *